US008387962B2

(12) United States Patent
Wisniewski

(10) Patent No.: US 8,387,962 B2
(45) Date of Patent: Mar. 5, 2013

(54) PORTABLE BOARD HOLDING APPARATUS FOR MARTIAL ARTS

(76) Inventor: Terrence Wisniewski, Edmonton (CA)

( * ) Notice: Subject to any disclaimer, the term of this patent is extended or adjusted under 35 U.S.C. 154(b) by 234 days.

(21) Appl. No.: 12/732,603

(22) Filed: Mar. 26, 2010

(65) Prior Publication Data

US 2010/0252975 A1 Oct. 7, 2010

(30) Foreign Application Priority Data

Apr. 1, 2009 (CA) ..... 2660549

(51) Int. Cl.

| | |
|---|---|
| ***B25B 1/22*** | (2006.01) |
| ***A63B 26/00*** | (2006.01) |
| ***A63B 69/34*** | (2006.01) |
| ***A63B 69/22*** | (2006.01) |
| ***A63B 69/24*** | (2006.01) |
| *B23Q 1/25* | (2006.01) |

(52) U.S. Cl. ..... 269/74; 482/90; 482/23; 482/83

(58) Field of Classification Search ..... 269/74; 482/90, 23, 83, 88, 86; D21/798; D29/100
See application file for complete search history.

(56) References Cited

U.S. PATENT DOCUMENTS

| | | | | | |
|---|---|---|---|---|---|
| 4,295,646 | A | | 10/1981 | Squire | |
| 4,546,966 | A | * | 10/1985 | Segura | 482/88 |
| 4,572,504 | A | | 2/1986 | DiBartolo | |
| 4,583,730 | A | * | 4/1986 | Gecht et al. | 482/83 |
| 4,667,954 | A | * | 5/1987 | McCorkle | 482/86 |
| 4,732,378 | A | * | 3/1988 | LeFebvre et al. | 482/88 |
| 4,757,989 | A | * | 7/1988 | Bauer, Jr. | 482/83 |
| 4,776,584 | A | | 10/1988 | Tilley et al. | |
| 4,787,625 | A | | 11/1988 | Chaloux | |
| 4,817,941 | A | * | 4/1989 | McCorry | 482/90 |
| 4,883,635 | A | * | 11/1989 | Goradesky | 482/83 |
| 4,946,159 | A | * | 8/1990 | Jones | 482/83 |
| 5,009,414 | A | * | 4/1991 | Bass | 482/83 |
| 5,232,368 | A | * | 8/1993 | Morgia | 434/247 |
| 5,254,062 | A | * | 10/1993 | Hoffman | 482/83 |
| 5,362,289 | A | * | 11/1994 | Holt | 482/83 |
| 5,415,371 | A | | 5/1995 | Kirchner | |
| 5,458,551 | A | | 10/1995 | Shenton | |
| 5,501,649 | A | * | 3/1996 | Queppet | 482/88 |
| D370,507 | S | * | 6/1996 | Kha | D21/798 |
| 5,665,035 | A | * | 9/1997 | Tumminia | 482/83 |
| 5,839,991 | A | * | 11/1998 | Hall | 482/23 |
| 6,149,553 | A | | 11/2000 | Antoszewski | |
| 6,258,013 | B1 | * | 7/2001 | Dabney | 482/83 |
| D489,846 | S | * | 5/2004 | Singh | D29/100 |
| 6,896,642 | B1 | | 5/2005 | Brown | |
| 7,056,238 | B1 | * | 6/2006 | Brown | 473/444 |
| 7,121,986 | B1 | * | 10/2006 | O'Dowd | 482/83 |

(Continued)

OTHER PUBLICATIONS

Superior Martial Arts. "Breaking Board Holders", http://www.superiormartialarts.com/, Accessed Jul. 21, 2010, Available at least as early as Jan. 8, 2009.

(Continued)

*Primary Examiner* — Lee D Wilson
*Assistant Examiner* — Alvin Grant
(74) *Attorney, Agent, or Firm* — Davis & Bujold, PLLC

(57) ABSTRACT

A board holding apparatus for martial arts which includes a body having handles, elongate attachment member anchor points and at least one pair of board support mountings. A pair of collapsible board supports are movably secured normal to the body at the board support mountings.

18 Claims, 5 Drawing Sheets

U.S. PATENT DOCUMENTS

| | | | | |
|---|---|---|---|---|
| 7,559,880 | B1 * | 7/2009 | Calhoun | 482/83 |
| 7,727,127 | B1 * | 6/2010 | Arrington | 482/83 |

OTHER PUBLICATIONS

Discount Martial Arts Supplies & Equipment. "Lightweight Board Holder", http://www.mykaratestore.com, Accessed Jul. 21, 2010. Available at least as early as Jan. 8, 2009.

"The Board Breaker", http://www.theboardbreaker.com. Accessed Jul. 21, 2010. Available at least as early as Feb. 2, 2009.

"Board Buster", http://www.boardbuster.net. Accessed Jul. 21, 2010. Available at last as early as Jan. 8, 2009.

The Karate Place. "Board Breaker by Century", http://www.thekarateplace.com/board_breaker_board_holder_by_century.htm, Accessed Jul. 21, 2010. Available at least as early as Jan. 8, 2009.

BlackBeltShop.com, "Proforce Break Mate Board Holder" http://www.blackbeltshop.com/proforce_break_mate_board_holder.htm. Accessed Jul. 21, 2010. Available at least as early as Jan. 8, 2009.

* cited by examiner

PORTABLE BOARD HOLDING APPARATUS FOR MARTIAL ARTS

FIELD

There is described a portable board holding apparatus which is used when breaking boards during martial arts training.

BACKGROUND

Board holding apparatuses are used when breaking boards during martial arts training. Many martial arts clubs have board holding apparatus which are installed as permanent installations. There is a need, however, for board holding apparatus that are portable. Portable board holding apparatus allow training to take place with a training partner at any desired location. Some examples of board holding apparatus which would be considered to be portable include: U.S. Pat. No. 4,732,378 (LeFebvre et al), U.S. Pat. No. 4,776,584 (Tilley et al) and U.S. Pat. No. 4,883,635 (Goradesky).

SUMMARY

There is provided a board holding apparatus for martial arts which includes a body having handles, elongate attachment member anchor points and at least one pair of board support mountings. A pair of collapsible board supports are movably secured normal to the body at the board support mountings.

While beneficial results may be obtained through the use of the board holding apparatus as described above, additional benefits may be obtained where the board supports are detachably secured normal to the body, and are collapsed by positioning the board supports parallel to the body.

While beneficial results may be obtained through the use of the board holding apparatus described above, an ability to accommodate different holding styles for different board breaking techniques can be added when there are two pairs of board support mountings; a first pair of board support mountings in spaced relation parallel to the handles and a second pair of board support mountings in spaced relation perpendicular to the handles.

While beneficial results may be obtained through the use of the board holding apparatus described above, there is a need to maintain the board supports in a stable orientation. A preferred wherein the at least one pair of board support mountings are comprised one of male engagements or female engagements, which matingly engage another of the male engagements or female engagements on the board supports. In the illustrated embodiment, the female engagements are on the body and the male engagements are on the board supports. The engagements can be reversed. For added stability, it is preferred that the male engagement extend for a majority of one side of each of the board supports.

The board supports could be held in position by attachment cords, such as bungee cords, which hold the boards in position. However, it is preferred that a first locking profile be provided on the body and a second locking profile be provided on the board supports. The first locking profile and the second locking profile engage to prevent the male engagement from being withdrawn from the female engagement.

If the board holding apparatus is to remain portable, it is important that the board holding apparatus be as light as possible. To decrease weight while maintaining requisite strength, it is preferred that the body and the board supports be moulded polymer plastic shells with integrally formed reinforcing ribs.

The board holding apparatus, as described above, can be used with a training partner, but cannot be used by an individual in the absence of a partner. Even more beneficial results may, therefore, be obtained when the body has an upper edge, a lower edge, and at least one vertical support passage extending through the body from the upper edge to the lower edge. Means is provided to secure a vertical support within the at least one vertical support passage of the body. The preferred vertical support is pole. The preferred means for securing the pole is a rotatable compression fitting being provided to clamp upon the vertical support pole.

Although beneficial results may be obtained though the use of the board holding apparatus as described above, even more beneficial results may be obtained when the vertical support is a pole which is separable into several segments for storage. Preferably storage is provided in the body.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
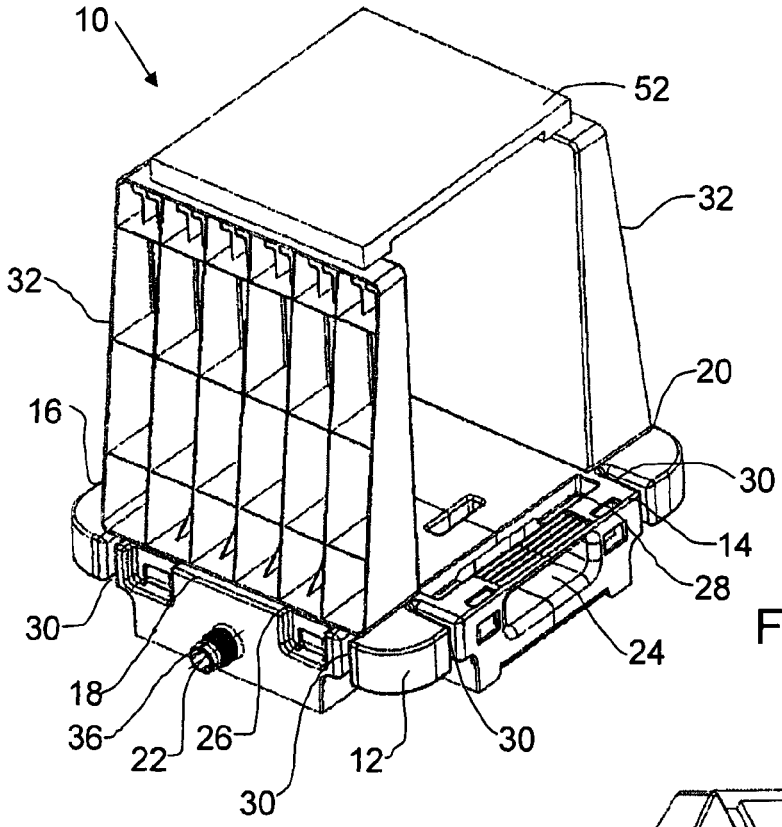
FIG. 1 is a top perspective view of the board handling apparatus.

A board holding apparatus for martial arts, generally identified by reference numeral 10, will now be described with reference to FIG. 1 through 10.

Figure 2:
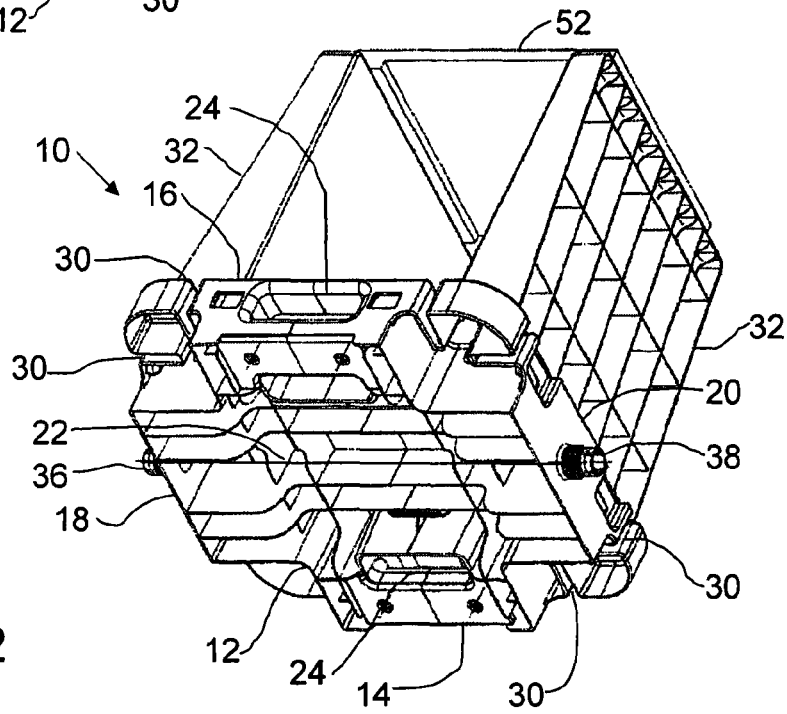
FIG. 2 is a bottom perspective view of the board handling apparatus.
Figure 3:
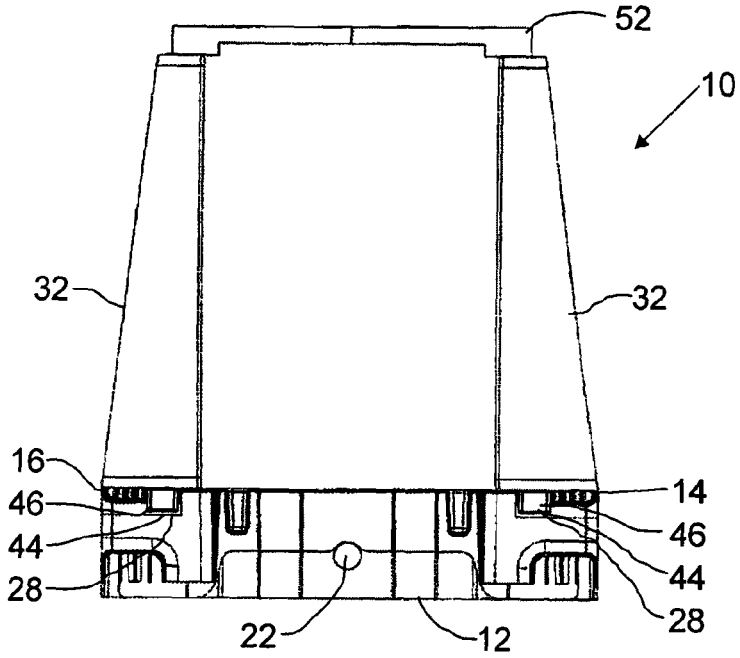
FIG. 3 is a side elevation view in section of the board handling apparatus with the board supports in the second pair of board support mountings.
Figure 4:
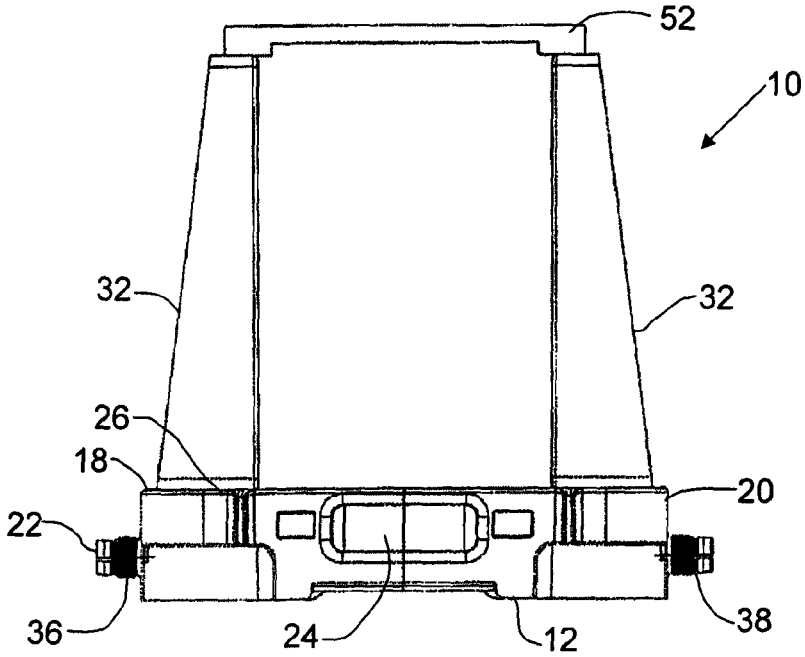
FIG. 4 is a side elevation view of the board handling apparatus with the board supports in the first pair of board support mountings.
Figure 5:
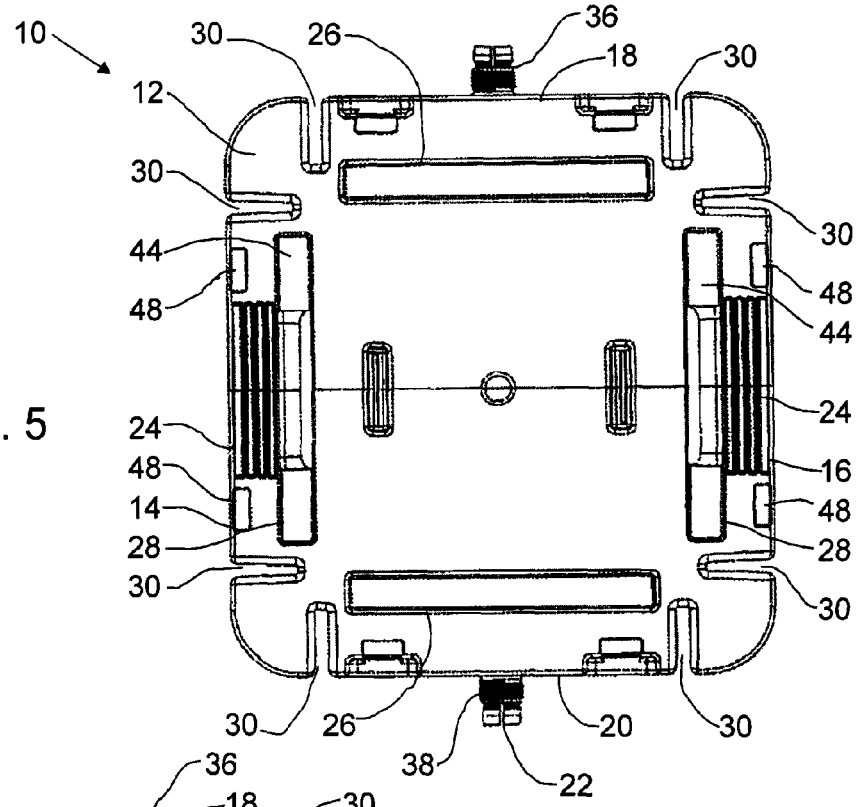
FIG. 5 is a top plan view of the body of the board support apparatus.

Structure and Relationship of Parts:

Referring to FIG. 5, board holding apparatus 10 has a body 12 with a first side edge 14, a second side edge 16, an upper edge 18, and a lower edge 20. There is a pair of handles 24 in spaced relation to each other. As shown, there are two pairs of board support mountings 26 and 28 in spaced relation to handles 24. First pair 28 are parallel to handles 24, and second pair 26 are perpendicular to handles 24. There are also pairs of elongate attachment member anchor points 30 along each of first side edge 14, second side edge 16, upper edge 18 and lower edge 20 for securing elongate attachment members to hold a board 52 to be broken, such as bungee cords, strips of hook and loop fasteners, straps, or other similar components. Referring to FIGS. 1 and 2, a pair of collapsible board supports 32 are movably secured normal to body 12. In a preferred embodiment, board supports 32 are removably secured, and are collapsed by placing them in parallel against body 12. Board supports 32 may be mounted at either first pair of board support mountings 26 as shown in FIG. 4 or second pair of board support mountings 28 as shown in FIG. 3. Board supports 32 are preferably planar, or slightly tapered as shown, such that when removed, they can be stacked in a way that minimizes the size of apparatus 10. The collapsed apparatus may then be strapped together such as with a hook and loop strap or bungee cord. In the depicted embodiment, a single pair of handles 24 are provided, and two board support mountings 26 and 28 with corresponding bungee cord anchor points 30 are provided, which allow a board 52 to be mounted in one of two directions. In other embodiments, there may be additional handles that allow body 12 to be reoriented instead of having to change the position of board supports 32. Board supports 32 may have a friction member (not shown) such as silicone or rubber tabs to keep boards 32 from slipping. Board supports 32 are preferably large enough to allow complete penetration after breaking the board, such as 14 inches. There may also be a pad (not shown) on body 12 between board supports 32.

Figure 6:
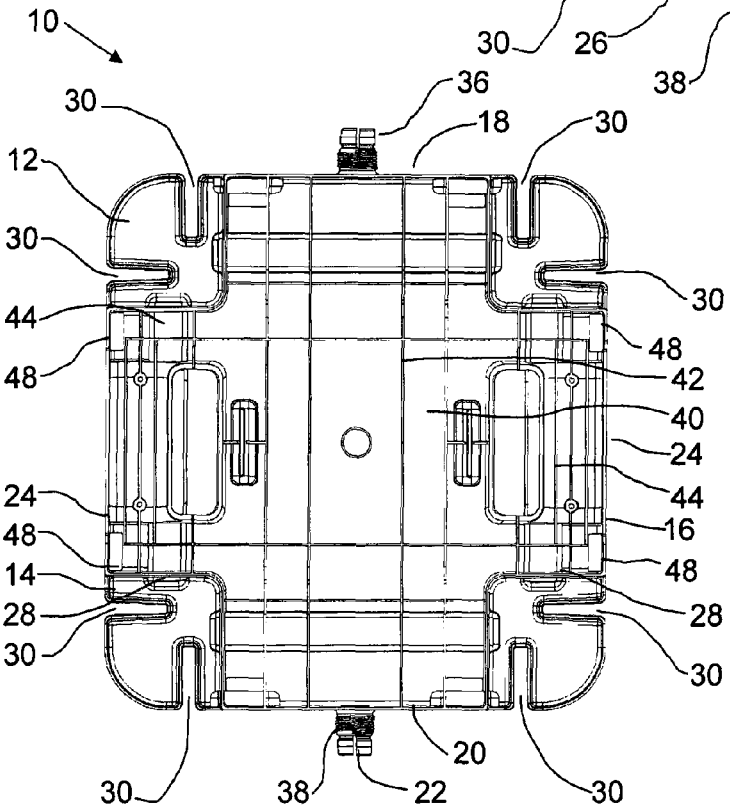
FIG. 6 is a bottom plan view of the board support apparatus.
Figure 8:
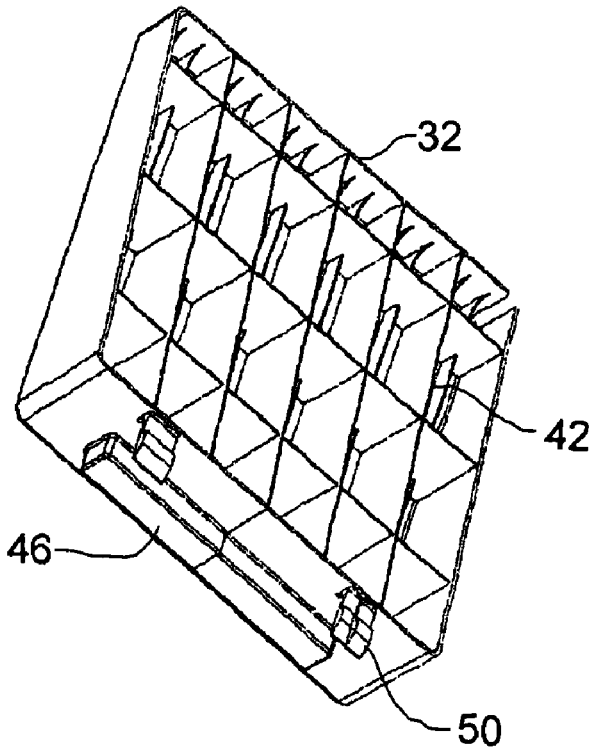
FIG. 8 is a perspective view of the board support.
Figure 9:
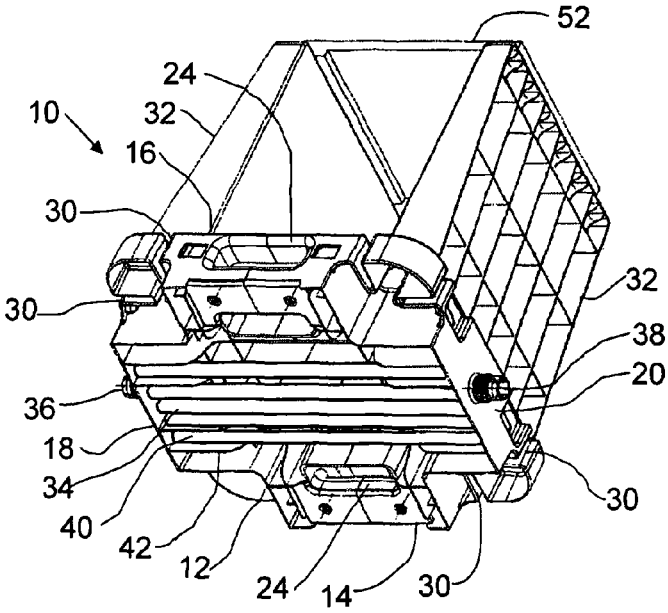
FIG. 9 is a bottom perspective view of the board handling apparatus storing a pole in sections.
Figure 10:
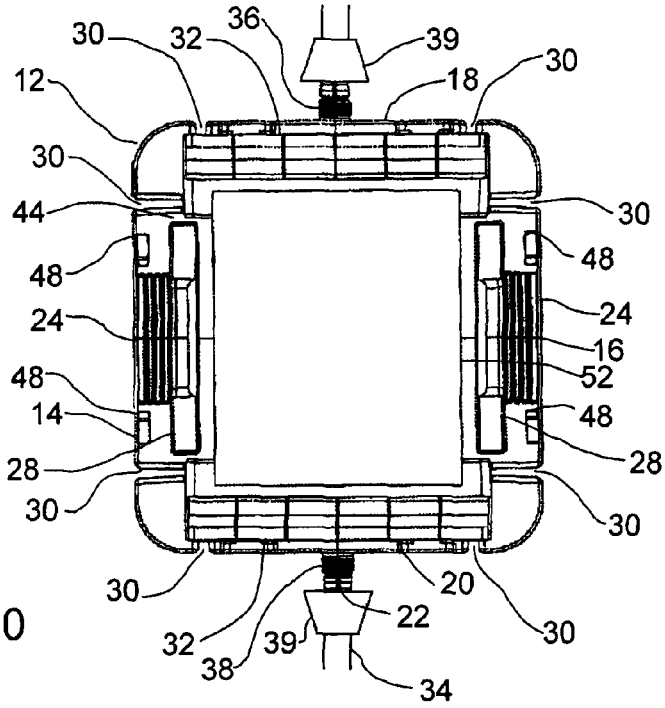
FIG. 10 is a top plan view of the board handling apparatus mounted on a pole.

Referring to FIG. 2, there is shown a vertical support passage 22 that extends through body 12 from upper edge 18 to lower edge 20. Referring to FIG. 10, there are provided means to secure a vertical support pole 34 within vertical support passage 22, such as an upper rotatable compression fitting 36 along upper edge 18 and a lower compression fitting 38 along lower edge 20. Compression fittings 36 and 38 are engaged by a compression nut 39 that is positioned on support pole 34. Other means that provide a similar result will be apparent to those in the art. Referring to FIGS. 8 and 9, in a preferred embodiment, body 12 and board supports 32 are moulded polymer plastic shells with integrally formed reinforcing ribs 42, but may also be a resin-based product. Referring to FIG. 9, vertical support pole 34 may be a pole that is separable into several segments for storage, with storage compartments 40 provided between reinforcing ribs 42 on body 12, as shown in FIG. 6.

Figure 7:
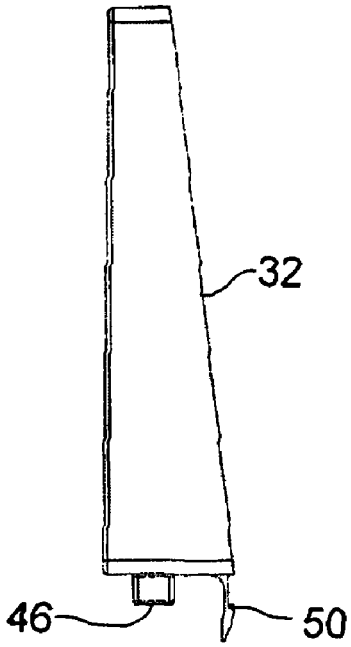
FIG. 7 is a side elevation view of the board support.

Referring to FIGS. 3 and 5, each of the pairs of board support mountings 26 and 28 on body 12 are comprised of female engagements 44, which extend for a majority of edges 14, 16, 18 and 20. Referring to FIGS. 7 and 8, each board support 32 has a male engagement 46 that extends along a majority of one side of each board support 32 and matingly engages the corresponding female engagement 44 on body 12. There may also be a first locking profile 48 on body 12 shown in FIG. 5, and a second locking profile 50 on board supports 32 shown in FIGS. 7 and 8, such that first locking profile 48 and second locking profile 50 engage to prevent male engagement 46 from being withdrawn from female engagement 44. As depicted, locking profiles 50 are resilient tabs that engage locking profile 48, which are holes in body 12. Other engagement designs for board support mountings 26 and 28 will be apparent, such as tongue and groove and pin connectors. Alternatively, board supports 32 may be connected to body 12 by hinges (not shown) that allow them to be folded down onto body 12 when not in use.

Operation:

Referring to FIG. 1 board holding assembly 10 is assembled by attaching board supports 32 to body 12. Referring to FIG. 3, this is done by inserting male engagement 46 into female engagement 44 on body 12 and such that locking profiles 48 and 50 engage. This is done in either first or second pair of board support mountings 26 or 28, as shown in FIGS. 3 and 4. Once assembled, a board 52 is placed on the tops of board supports 32 as shown, and are tied down using cord, such as bungee cords, that are attached to body 12 at anchor points 30. If supported by a person, board holding assembly 10 is then supported using handles 24 by either one or two people while the board is broken by a martial arts practicioner. If supported by pole 34, pole 34 is inserted through compression fittings 36 and 38 and along vertical support passage 22. Compression fittings 36 and 38 are then secured once the selected position is reached. Pole 34 may be balanced vertically by being mounted to a fixed structure or held. When placed against the fixed structure, body 12 is placed directly against the structure with pole 34 recessed from it, such that pole 34 only supports the weight of assembly 10. Pole 34 may have a friction member (not shown) on the end that contacts the ground to increase stability.

Advantages:

While other portable board holders are available, the board holding assembly 10 described herein is able to be collapsed to a small size by removing board supports 32, and laying them parallel on body 12, such that the height in the collapsed version is relatively small, and can fit in a case similar in size to a laptop case. The design of board holding assembly 10 is also such that an integrally formed body is not necessary, as board supports 32, body 12 and the engagement is sufficiently strong to withstand the typical forces involved with board breaking. In addition, the design of support mountings 26 and 28 in the preferred embodiment do not require any pin connections such as nuts and bolts or screws to be assembled.

Board holding assembly 10 is also designed to be used in various ways. It can be held by handles 24 for either horizontal or angled brakes, strapped to a heavy bag using known strapping techniques, set on the floor for vertical breaks, or mounted on pole 34. Pole 34 is placed against a support surface, such as a cement wall or other structure. Pole 34 is used to support the weight of assembly 10, and may either be balanced vertically by clips on the support surface, or by an assistant. The compression fittings 36 and 38 allow the height to be adjusted quicky.

When not in use, pole 34 may be separated into shorter lengths, and stored in storage compartments 40 formed by reinforcing ribs 42 on the back of body 12. Board supports 32 are removed from body 12, and may be strapped to body 12 in a parallel fashion, such as by using the bungee cords, or using a hook and loop design.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A board holding apparatus for martial arts comprising:

a body having handles, anchor points for elongate attachment members and at least one pair of board support mountings carried by the body;

elongate attachment members attached to the anchor points and movable relative to the body; and a pair of rigid, collapsible board supports secured directly to the board support mountings and extending normal to the body, wherein in use, the elongate attachment members secure one or more boards against the board supports.

2. The board holding apparatus of claim 1, wherein the board supports are detachably secured normal to the body, and are collapsed by positioning the board supports parallel to the body.

3. The board holding apparatus of claim 1, comprising a first pair of board support mountings in spaced relation parallel to the handles and a second pair of board support mountings in spaced relation perpendicular to the handles, the pair of board supports being mounted to one of the first pair or second pair of board support mountings to change the orientation of a board to be broken relative to the handles.

4. The board holding apparatus of claim 1, wherein the at least one pair of board support mountings are comprised of male engagements or female engagements and are matingly engaged by another of male engagements or female engagements on the board supports.

5. The board holding apparatus of claim 4, wherein the female engagements are on the body and the male engagements are on the board supports.

6. The board holding apparatus of claim 4, wherein the male engagement extends for a majority of one side of each of the board supports.

7. The board holding apparatus of claim 4, wherein a first locking profile is provided on the body and a second locking profile is provided on the board supports, the first locking profile and the second locking profile engaging to prevent the male engagement from being withdrawn from the female engagement.

8. The board holding apparatus of claim 1, wherein the body and the board supports are moulded polymer plastic shells with integrally formed reinforcing ribs.

9. The board holding apparatus of claim 1, wherein the body has an upper edge and a lower edge, at least one vertical support passage extending through the body from the upper edge to the lower edge, and means being provided to secure a vertical support within the at least one vertical support passage of the body.

10. The board holding apparatus of claim 9, wherein a compression fitting being provided to clamp upon the vertical support.

11. The board holding apparatus of claim 9, wherein the vertical support is a pole which is separable into several segments for storage.

12. The board holding apparatus of claim 1, wherein the elongate attachment member anchor points are bungee cord anchor points.

13. A board holding apparatus for martial arts, comprising:

a body having a first side edge, a second side edge, an upper edge, a lower edge, at least one vertical support passage extending through the body from the upper edge to the lower edge, a pair of handles in spaced relation to each other, a first pair of board support mountings carried by the body and in spaced relation parallel to the handles, a second pair of board support mountings carried by the body and in spaced relation perpendicular to the handles, a pair of attachment cord anchor points along the first side edge, a pair of attachment cord anchor points along the second side edge, a pair of attachment cord anchor points along the upper edge and a pair of attachment cord anchor points along the lower edge;

a pair of board supports detachably secured directly to one of the first or second pairs of board support mountings and extending normal to the body; and an attachment to secure a vertical support pole within the at least one vertical support passage of the body;

attachment cords attached to two or more attachment cord anchor points, such that in use, the attachment cords secure one or more boards against the board supports;

the body and the board supports being moulded polymer plastic shells with integrally formed reinforcing ribs.

14. The board holding apparatus of claim 13, wherein each of the first pair of board support mountings and the second pair of board support mountings on the body are comprised of female engagements, which extend for a majority of the first side edge, the second side edge, the upper edge, and the lower edge; and each of the board supports having male engagements which extend along a majority of one side of each of the board supports and matingly engage the female engagements on the body.

15. The board holding apparatus of claim 14, wherein a first locking profile is provided on the body and a second locking profile is provided on the board supports, the first locking profile and the second locking profile engaging to prevent the male engagement from being withdrawn from the female engagement.

16. The board holding apparatus of claim 13, wherein the attachment to secure a vertical support pole within the at least one vertical support passage of the body is an upper compression fitting along the upper edge and a lower compression fitting along the lower edge.

17. The board holding apparatus of claim 13, wherein the vertical support is a pole which is separable into several segments for storage, and storage compartments are provided between the reinforcing ribs on the body.

18. The board holding apparatus of claim 13, wherein the attachment cord anchor points are bungee cord anchor points.

* * * * *